United States Patent [19]

Rentema

[11] 3,962,783

[45] June 15, 1976

[54] TRIMMING UNIT

[75] Inventor: Albertus Pieter Rentema, Drachten, Netherlands

[73] Assignee: U.S. Philips Corporation, New York, N.Y.

[22] Filed: Mar. 27, 1975

[21] Appl. No.: 562,494

[30] Foreign Application Priority Data

Apr. 29, 1974 Netherlands ..... 7405728

[52] U.S. Cl. ..... 30/34.1; 30/223

[51] Int. Cl.[2] ..... B26B 19/10

[58] Field of Search ..... 30/34.1, 43.1, 43.91, 30/43.92, 210, 221–224

[56] References Cited

UNITED STATES PATENTS

| | | | |
|---|---|---|---|
| 2,827,695 | 3/1958 | Vitale | 30/43.92 X |
| 3,233,324 | 2/1966 | Heide | 30/34.1 X |
| 3,644,990 | 2/1972 | Crookes | 30/34.1 |
| 3,780,434 | 12/1973 | Boer | 30/34.1 |
| 3,842,498 | 10/1974 | Mizobata | 30/43.92 |

*Primary Examiner*—Al Lawrence Smith
*Assistant Examiner*—Gary L. Smith
*Attorney, Agent, or Firm*—Frank R. Trifari; J. David Dainow

[57] ABSTRACT

A trimming unit with stationary and axially movable cutters, and a coupling member which drives the movable cutter, and helical springs disposed at either side of the coupling member for urging the cutters against each other, and for urging the movable cutter to return to its neutral position.

6 Claims, 3 Drawing Figures

TRIMMING UNIT

BACKGROUND OF THE INVENTION

The invention relates to a trimming unit for use in conjunction with a personal care appliance, such as a dry-shaving apparatus or a hair clipper. Such a unit comprises a frame, a stationary cutter which is disposed at the frame and provided with teeth at its front, a movable cutter which engages with the stationary cutter and is provided with teeth near those of the stationary cutter, a spindle, which is disposed at the frame at some distance from and parallel to the toothed front side of the stationary cutter, a coupling member, which is disposed at the spindle and which is both longitudinally reciprocatable relative thereto and pivotable about it, which member can be coupled to the movable cutter at some distance from the spindle and furthermore comprises parts for coupling to a drive motor, and resilient means which include a helical wire spring which is disposed around the spindle, which spring near its ends comprises extensions of which a first extension, at some distance from the spindle, presses on the coupling member and thus presses the cutters into engagement with each other.

A trimming unit of this type is known from Swiss Patent No. 403,551, disclosing a trimming unit which as a separate attachment can be fitted on a housing which accommodates a drive motor. The stationary trimming cutter is rigidly connected to a plate which in its turn is coupled with appropriate parts of the housing. This plate forms a part of the frame on which also the spindle is disposed about which and over which the coupling member for driving the reciporcating trimming cutter is pivotable and slidable respectively. The coupling member is substantially shaped as a two-armed lever whose arms make an angle with each other. One arm cooperates with the reciprocatable trimming cutter, and the other arm serves for driving the coupling member. The two arms are not rigidly connected to each other but are pivotable to a limited extent about the spindle relative to each other. The helical spring which is disposed around the spindle, with its first extended end, presses against the lever which serves for coupling to the movable cutter and with its other extended end against the arm which serves for driving. In the situation in which the trimming unit is not attached to the housing of the appliance, the two arms are pressed apart by the spring into a position in which mutual stops prevent the angle between the two arms from increasing any further. In the situation in which the unit is attached to the appliance, the drive pin which extends from the housing and which is connected to the drive motor presses the lever for the trimmer drive a little way into the direction of the other lever. As a result of this, the spring exerts a certain pressure on the other lever, which pressure is imparted to the movable trimming cutter and by said cutter to the stationary trimming cutter, so that the two trimming cutters are pressed firmly against each other.

SUMMARY OF THE INVENTION

It is an object of the invention to provide a trimming unit for use in conjunction with a personal care appliance, specifically for a dry-shaving apparatus, which forms an improvement with respect to the present state of the art, i.e. in particular with respect to the height of the construction and the consequent space required for mounting in an appliance. The invention is characterized in that two such springs are disposed at either side of the coupling member around the spindle, and that the two extensions extend in substantially the same direction as the first extensions and their ends are disposed in recesses in a stationary part of the trimming unit.

In view of the movements which the first ends perform relative to the coupling member one importand embodiment is characterized in that the first ends engage with V-shaped recesses.

An embodiment which has been found to perform satisfactorily in practice is characterized in that the frame consists of a single component which is made of a thermoplastic material which comprises a rectangular covering plate with raised edges at the two short sides and at one of the long sides, cams for retaining the stationary cutter and guiding the movable cutter, with recesses for the two extensions of the springs formed in the cams for guiding the movable cutter. The spindle is snapped into the covering plate, and the coupling member also consists of a single plastic component which is substantially plate-shaped and which extends parallel to the covering plate and is provided with coupling pin which extends in an opening of the movable cutter and with a drive coupling member.

In order to minimize the power required for driving the trimming unit according to the invention a further embodiment is of interest, which is characterized in that the spindle is mounted with axial play.

The invention will now be described in more detail with reference to the drawing

DETAILED DESCRIPTION OF THE PREFERRED EMBODIMENT

Figure 1:
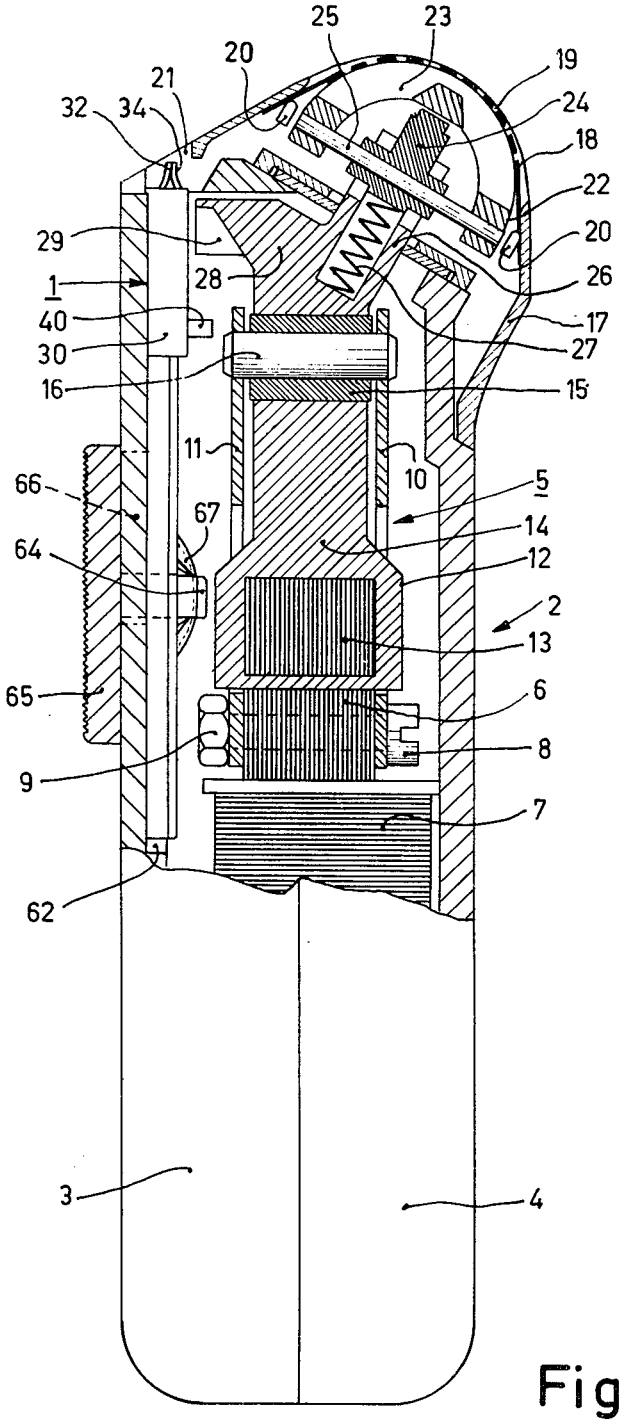
FIG. 1 is a partially sectioned, side elevation of a dry-shaving apparatus with a vibrator motor and with a trimming unit which is movably disposed in the housing of the appliance.

The Figures show a trimming unit 1 which is incorporated in a dry-shaving apparatus 2 of a type which is known per se. It comprises a plastic housing which consists of two sections 3 and 4, which accommodate a vibrator motor 5. The motor comprises a stator lamination core 6 and two electrical coils 7, of which one coil is visible in FIGS. 1 and 2. To the stator lamination core 6 two supporting plates 10 and 11 are secured by means of bolts 8 and 9, which plates support the armature 12 of the vibrator motor. The armature comprises an armature lamination core 13, mounted in a plastic pivotable plastic lever 14, the lever being pivoted to a spindle 16 with the aid of a bearing 15, which spindle is fixed in the plates 10 and 11.

On the housing a cap 17 in which a perforated arcuated shear foil 18 is secured which is provided with a multitude of hair entrance apertures 19. The foil is secured to the inside of the cap 17 at its long sides with the aid of hook-shaped projections 20. Furthermore the cap is provided with a slotted opening 21 through which the extendible trimming unit 1 can be slid out. Against the inner side of the shear foil a cutting block 22 is pressed which comprises a multitude of individual cutters 23. By means of a coupling member 24 and a spindle 25, the cutting block 22 is pivotably mounted on the drive member 26 which is integral with the armature 12. The drive member is hollow and contains a pressure spring 27 which presses against the coupling member 24 and thus presses the cutting block 22 against the underside of the arcuated shear foil 18.

In addition to the drive member 26 the armature 12 comprises a second drive member 28, which has a slightly tapered opening 29 and serves for driving the trimming unit.

Figure 3:
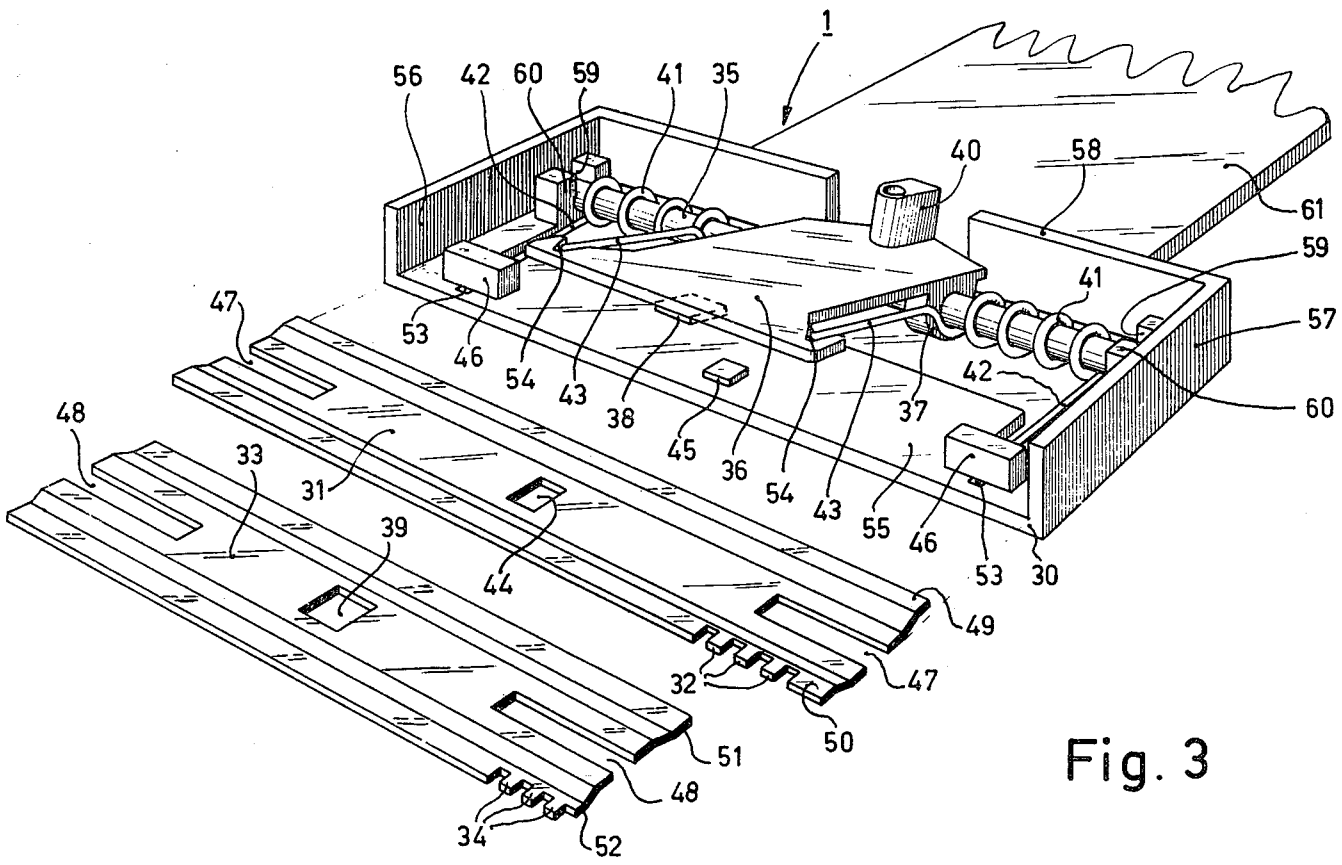
FIG. 3 is an exploded view of the trimming unit used in the shaving apparatus of FIGS. 1 and 2.

The trimming unit, see FIG. 3 in particular, comprises a frame 30, a stationary cutter 31 which is disposed on the frame 30, and at its front side is provided with teeth 32, as well as a movable cutter 33 which engages with the stationary cutter 31 and is provided with teeth 34. On the frame 30 a spindle 35 is mounted at some distance from and parallel to the side of the stationary cutter 31 which is provided with teeth 32. On the spindle 35 a plastic coupling member 36. It is provided with two lugs 37 through which the spindle 35 is passed, so that the coupling member 36 is reciprocatable in the longitudinal direction of the spindle 35 and is thus also hingeable. At some distance from the spindle 35 the coupling member 36 has a rectangular projection 38 which corresponds to a coupling slot 39 in the drivable trimming cutter 33. Furthermore, the coupling member comprises a second coupling pin 40 which serves for driving the trimming unit by means of the vibrator motor and which can cooperate with the tapered opening 29 in the drive member 28 of the motor 5.

Around the spindle 35 are two helical wire springs 41 which have near their ends extensions 42 and 43 which press on the coupling member 36 at some distance from the spindle 35 and thus press the trimming cutters 31 and 33 against each other.

The trimming cutters are of a conventional type and are made of sheet steel. In order to prevent the stationary cutter 31 from moving axially, it has a central opening 44 which corresponds to projection 45 on the frame 30. Moreover, two further projections or cams 46 are disposed on the frame 30. The stationary cutter 31 has slots 47 and the drivable cutter 33 has slots 48 which correspond to the cams 46. The slots 48 have a length permitting the cutter 33 to reciprocate freely over a substantial distance, with the cams 46, in conjunction with the slots 48, providing parallel guidance of the movable cutter 33. The two cutters 31 and 33 have a slightly bent shape. Only the parallel-ground faces 49 and 50 of the stationary cutter 31 are then in contact with the also parallel-ground faces 51 and 52 of the movable cutter.

The extensions 42 of the springs 41 extend substantially in the same direction as the extensions 43 with their ends disposed in recesses 53 in the frame 30. These recesses are located underneath the cams 46 and thus underneath the stationary cutter 31. The extensions 43 engage with their ends with V-shaped recesses 54 of the coupling member 36.

The frame 30 consists of a single thermoplastics component having a rectangular cover plate 55 with raised edges 56 and 57 at the two short sides and furthermore with a locally interrupted raised edge 58 at one of the long sides. The spindle 35 is at either side snapped into the open mounting slots 59 in the bearings 60. The frame 30 also comprises an integral guide strip 61 which cooperates with a corresponding guide slot 62 formed in the section 3 of the housing of the dry-shaving apparatus. The guide strip 61 has two openings 63, through which the pins 64 of the slide knob 65 extend. The housing section 3 comprises two slotted openings 66 which correspond to the pins 64. At the ends of the pins 64 which extend through the guide strip 61 cup-shaped springs 67 are disposed, which ensure that the slide knob is pressed against the housing 3 and the guide strip 61 against the inner side of said housing section.

Figure 2:
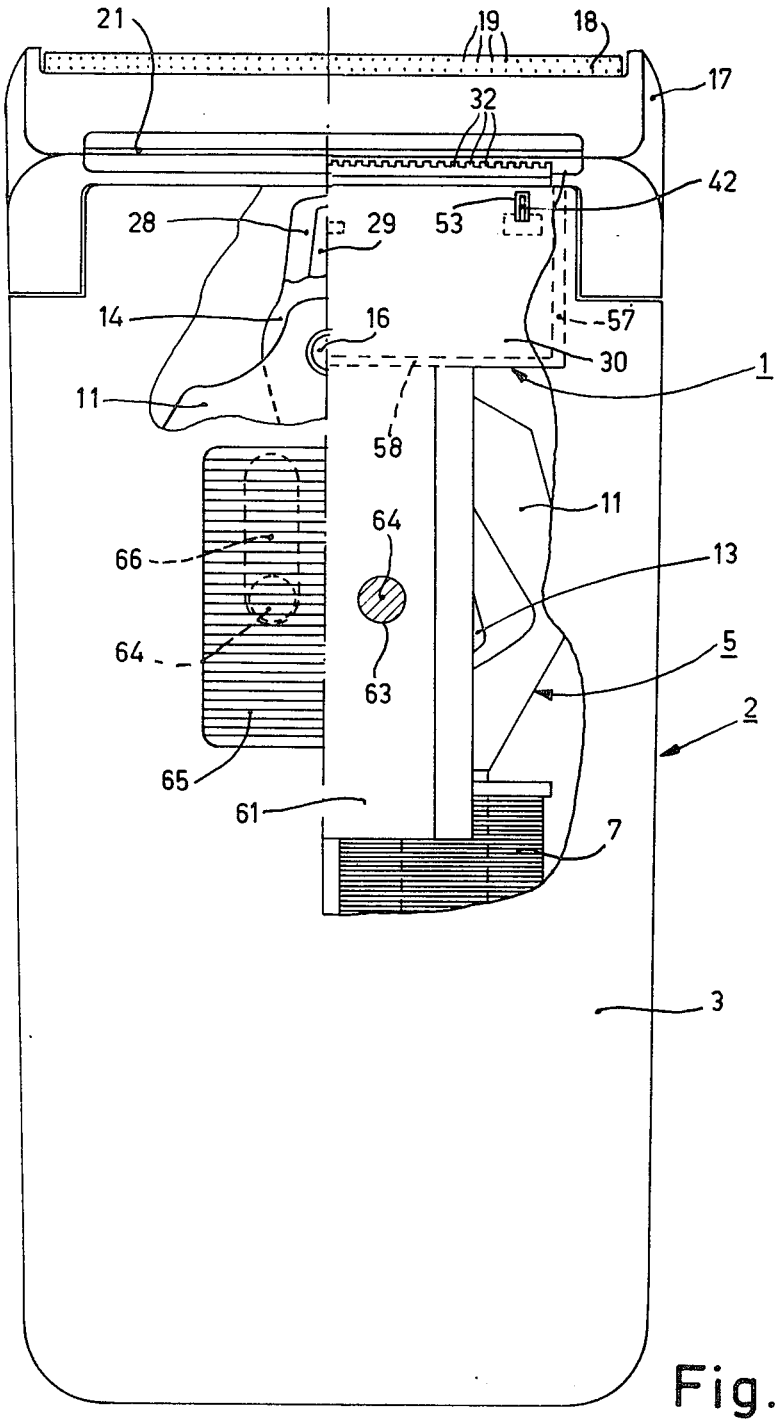
FIG. 2 is a partially sectioned, front elevation of the dry-shaving apparatus of FIG. 1.

A user of the dry-shaving apparatus according to FIGS. 1 and 2 can move the trimming unit with the aid of the slide knob 65. By sliding the slide knob 65 in the direction of the cap 17 the trimming unit 1 is slid out through the slotted opening 21 of the cap 17 into a position in which the coupling pin 40 cooperates with the drive member 28. To retract the trimming unit into the housing of the shaving apparatus the reverse sequence of operation is applied, in other words, the slide knob 65 is slid in a direction away from the cap 17. As a result of this, the trimming unit is retracted into the housing and at the same time the drive of the trimming unit is disengaged.

The trimming unit according to the invention is of an extremely flat construction and thus demands little mounting space. An important additional advantage of the use of the springs 41 is that in view of the comparatively great length of the wire which is used for the spring, the properties of the spring do not substantially depend on material and production tolerances. Moreover, they serve a dual purpose: pressing the coupling member in position and thus pressing the two trimming cutters into engagement, and returning the coupling member 36 to its neutral position in the axial direction. Said last-mentioned function of the springs promotes a good performance of the trimming unit and renders it extremely suitable for being driven by a vibrator motor. Furthermore, it is to be noted, that there are no frame points which must be capable of withstanding a substantial spring pressure, because the assembly which consists of the two trimming cutters 31 and 33 and the springs 41 forms a system with internal forces only.

The invention is not limited to the embodiment shown. Although in the drawing the trimming unit is employed in a dry-shaving apparatus it may alternatively be used in other appliances such as a hair clipper.

What is claimed is:

1. In an electric shaver including a housing, an electric motor with a reciprocating armature in said housing, and a shaving head with a shaving cutter therein coupled to and driven by said armature, the improvement in combination therewith of a trimming unit comprising: a frame slidably mounted to said housing, a pair of stationary and movable blades removably mounted on said frame, said blades each having a row of teeth which cooperate in cutting action, a spindle carried by the frame, coupling means comprising a coupling member axially and pivotally movable on said spindle, a first coupling element on said member for engaging said armature, a second coupling element on said member for engaging said movable blade, said frame being slidable between its inactive position wherein said first coupling element is spaced from said armature and its active position wherein said first coupling element is engaged to said armature, said coupling member being pivotable between closed position wherein its second coupling element engages the movable blade, and open position wherein said coupling member is pivoted away from said movable blade allowing easy removal of said two blades from said frame, and helical spring means around said spindle and engaging said frame and also engaging said coupling member, said spring means resiliently urging said coupling member into its closed position and against said movable blade, which is thereby resiliently urged against said stationary blade when said frame is in its active position.

2. Apparatus according to claim 1 wherein said spring means comprises a pair of helical springs axially spaced apart on said spindle with said coupling member positioned intermediate and engaging said springs, said coupling member has a neutral axial position on said spindle, said coupling member is reciprocated axially from said neutral position by said armature, and said springs resiliently urge said member to return to its neutral position when reciprocated.

3. Apparatus according to claim 1 wherein said trimming unit is substantially within said housing when said frame thereof is in its inactive position, and said teeth of said blades extend out of said housing when said frame is moved to its active position.

4. Apparatus according to claim 2 wherein said helical springs each have opposite end parts which extend transversely of the spring axis, one extension of each spring engaging said frame, and the other extension of each spring engaging said coupling member.

5. Apparatus according to claim 4 wherein said coupling member comprises V-shaped recesses and said springs engage said coupling member by said extension thereof being positioned in said recesses.

6. In an electric shaver including a housing, an electric motor with a reciprocating armature in said housing, and a shaving head with a shaving cutter therein coupled to and driven by said armature, the improvement in combination therewith of a trimming unit comprising: a frame movably mounted to said housing, a pair of stationary and movable blades removably mounted on said frame, said blades each having a row of teeth which cooperate in cutting action, a spindle carried by the frame, coupling means comprising a coupling member axially and pivotally movable on said spindle, a first coupling element on said member for engaging said armature, a second coupling element on said member for engaging said movable blade, said frame being movable between its inactive position wherein said first coupling element is spaced from said armature and its active position wherein said first coupling element is engaged to said armature, said coupling member being pivotable between closed position wherein its second coupling element engages the movable blade, and open position wherein said coupling member is pivoted away from said movable blade allowing easy removal of said two blades from said frame, and spring means engaging said frame and engaging said coupling member, said spring means resiliently urging said coupling member into its closed position and against said movable blade, which is thereby resiliently urged against said stationary blade when said frame is in its active position.

* * * * *